US007150901B2

(12) United States Patent
Campbell et al.

(10) Patent No.: US 7,150,901 B2
(45) Date of Patent: Dec. 19, 2006

(54) PLASMA TREATMENT OF POROUS INKJET RECEIVERS

(75) Inventors: Bruce C. Campbell, Webster, NY (US); Lisa B. Todd, Rochester, NY (US); James A. Reczek, Rochester, NY (US); Mary Catherine S. Oldfield, Rochester, NY (US); Hengzhong K. Zhuang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 91 days.

(21) Appl. No.: 10/729,206

(22) Filed: Dec. 5, 2003

(65) Prior Publication Data

US 2005/0123696 A1 Jun. 9, 2005

(51) Int. Cl.
*B41M 5/00* (2006.01)

(52) U.S. Cl. ..... 428/32.14; 428/32.15; 428/32.34

(58) Field of Classification Search ..... 428/32.3, 428/32.1

See application file for complete search history.

(56) References Cited

U.S. PATENT DOCUMENTS

| | | | | |
|---|---|---|---|---|
| 5,605,750 | A | 2/1997 | Romano et al. | |
| 5,780,118 | A | 7/1998 | Tracy et al. | |
| 6,045,917 | A * | 4/2000 | Missell et al. | 428/32.29 |
| 6,399,159 | B1 | 6/2002 | Grace et al. | |
| 6,565,930 | B1 | 5/2003 | Grace et al. | |
| 2003/0082353 | A1 | 5/2003 | Anagnostopoulos et al. | |
| 2003/0118790 | A1 * | 6/2003 | Iida et al. | 428/195 |

FOREIGN PATENT DOCUMENTS

| | | |
|---|---|---|
| EP | 1 029 702 A | 8/2000 |

* cited by examiner

*Primary Examiner*—Pamela R. Schwartz
(74) *Attorney, Agent, or Firm*—Chris P. Konkol

(57) ABSTRACT

An inkjet recording element comprising a porous ink-receiving layer having interconnecting voids is disclosed in which an upper surface of the ink-receiving layer has been subjected to plasma treatment, and wherein the upper surface of the ink-receiving layer, prior to the plasma treatment, has a measured carbon elemental content of at least 40 percent. The invention can provide increased dot spread.

14 Claims, No Drawings

PLASMA TREATMENT OF POROUS INKJET RECEIVERS

FIELD OF THE INVENTION

This invention relates to an inkjet recording element. More particularly, this invention relates to an inkjet recording element comprising a porous ink-receiving layer containing at least 40 percent elemental carbon in a surface layer thereof which is plasma treated. The invention also relates to a method of making such an inkjet recording media and a method for printing on such media.

BACKGROUND OF THE INVENTION

In a typical inkjet recording or printing system, ink droplets are ejected from a nozzle at high speed toward a recording element or medium to produce an image on the medium. The ink droplets, or recording liquid, generally comprise a recording agent, such as a dye or pigment, and a large amount of solvent in order to prevent clogging of the nozzle. The solvent, or carrier liquid, typically is made up of water, an organic material such as monohydric alcohol, a polyhydric alcohol, or mixtures thereof.

Inks used in various inkjet printers can be classified as either dye-based or pigment-based. In dye-based inks, the colorant is molecularly dispersed or solvated by a carrier medium. In pigment-based inks, the colorant exists as discrete particles. It is known that pigment-based inks perform better than dye-based inks with respect to stability properties such as light fade or ozone fade.

An inkjet recording element typically comprises a support having above, not necessarily adjacent, at least one surface thereof an ink-receiving or image-forming layer. The ink-receiving layer can be either porous or swellable.

In general, porous inkjet receivers absorb ink much faster than swellable inkjet receivers. This allows handling of the print sooner and the propensity of image artifacts such as coalescence are reduced. There are many porous inkjet receivers available today. They include porous glossy receivers comprised of small (<200 nm) inorganic particles and binder, which is usually an organic polymer. The polymeric binder can be hydrophilic in nature, for example poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin. The polymeric binder may also be hydrophobic in nature. Examples of hydrophobic binders include poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate or a copolymer of vinylacetate and n-butylacrylate.

For these porous glossy receivers, the typical weight ratio of inorganic particles to organic binder ranges from 75:25 to 95:5. There has to be enough binder present to adhere the inorganic particles together and provide integrity of the layer. If too much binder is present, however, porosity or void volume of the layer is reduced, resulting in slower drying rates and increased propensity for image artifacts.

It has been found that when these porous glossy receivers are printed with pigmented inks, very little dot spread occurs as a result of the ink droplet hitting the receiver surface. Although this is desirable, to some extent, from an image sharpness standpoint, it may be undesirable for printing efficiency and print density. When an ink drop hits the receiver surface and can spread, it increases the ink covering power resulting in higher densities.

U.S. Pat. Nos. 6,399,159 and 6,565,930 discuss the use of plasma treatment of paper and polyolefin imaging supports for obtaining the proper surface characteristics to promote adhesion of photosensitive coating materials, image forming layers, non-photosensitive polymeric coatings or laminates, and/or layers typically coated thereon. However, there is no teaching of plasma treatment directly to the surface ink-receiving layer for inkjet applications.

U.S. Pat. No. 5,605,750 discloses an opaque recording for use in an inkjet printer comprising a lower layer of a solvent-absorbing microporous material and an upper image-forming layer of porous pseudo-boehmite. A corona-discharge treatment may be applied to the lower microporous material layer before application of the upper image-forming layer for improved adhesion of the layer. However, there is no mention of plasma treatment to the uppermost surface layer for enhanced dot spread.

It is the object of this invention to provide an inkjet receiving element that has increased dot spread and printing density when printed with pigmented ink.

SUMMARY OF THE INVENTION

These and other objects are achieved in accordance with the invention which comprises a porous inkjet recording element that has been plasma treated on the imaging surface, wherein at least 40 percent elemental carbon, based on the elemental content, is in a surface layer thereof prior to the plasma treatment.

For many porous inkjet receivers, there is very little dot spread when printing with pigmented inks. As a result, banding artifacts as well as reduced optical densities occur. These problems can be minimized by increasing to some extent the dot spread of the printed ink.

Applicants found that plasma treatment of the surface of these porous glossy receivers prior to printing did not significantly increase the dot spread when printed with pigmented ink. Unexpectedly, however, plasma treatment of porous receivers containing greater than 40% elemental carbon at the surface resulted in increased dot spread and higher print densities.

The invention also relates to a corresponding method of making such an inkjet recording media, which method comprises providing a sheet material comprising at least one inkjet recording element, in cut or uncut form, in which the top layer is an ink-permeable porous ink-receiving layer containing at least about 40% elemental carbon content; and subjecting an upper surface of the ink-receiving layer to plasma treatment. If the sheet material being treated comprises a plurality of elements, they can be cut or divided into individual units following treatment. Alternatively, the already cut individual units can be plasma treated. In any case, the method can further comprise packaging a plurality of the plasma treated inkjet recording elements for distribution and sale to users of the inkjet recording elements for use in an inkjet printing process.

The invention is also directed to an inkjet printing process, comprising the steps of:

A) providing an inkjet printer that is responsive to digital data signals;

B) loading the printer with an inkjet recording element comprising an inkjet recording element as described above;

C) loading the printer with inkjet ink compositions; and

D) printing on the inkjet recording element using the inkjet ink in response to the digital data signals.

In a preferred embodiment of the printing process, the ink compositions are pigmented inks as compared to dye-based inks.

The term "ink-permeable" is defined by the Applicants to mean that either the ink recording agent and/or the carrier for the recording agent is capable of being efficiently transported into the microvoided layer during use.

As used herein, the terms "over," "above," and "under" and the like, with respect to layers in the inkjet media, refer to the order of the layers over the support, but do not necessarily indicate that the layers are immediately adjacent or that there are no intermediate layers.

DETAILED DESCRIPTION OF THE INVENTION

In a preferred embodiment of the invention, an inkjet recording element according to the present invention comprises a support having above at least one surface thereof (not necessarily adjacent) an ink-receiving or image-forming layer. The ink-receiving layer is porous. The support, if porous with interconnecting voids, could also be the inkjet recording element by itself with no additional ink-receiving layer or layers.

As indicated above, the porous ink-receiving layer contains at least 40 percent elemental carbon in a surface layer thereof, prior to being subjected to plasma treatment. This "percent elemental carbon in a surface layer" is herein defined as based on an X-ray photoelectron spectroscopy (XPS) measurement in which samples of the inkjet recording element are analyzed for elemental content on the imaging side surface at a depth of 5 nm. The analysis includes all elements except hydrogen and is normalized on a 100 percent basis. Such a measurement is exemplified in the Examples. Equivalent XPS analysis techniques and equipment may be employed for this measurement.

Preferably, the pre-plasma-treated porous ink-receiving layer contains at least 45 percent elemental carbon, based on the elemental content, in a surface layer thereof and more preferably at least 50 percent elemental carbon, most preferably at least 60 percent elemental carbon. In one preferred embodiment, the pre-plasma-treated porous ink-receiving layer contains not more than about 35 percent elemental oxygen in the surface layer thereof.

The percent elemental carbon in the surface layer can be provided by one or more organic materials. In one embodiment, such organic material includes an organic-polymer-containing continuous phase that is voided and/or filled with particles. Preferably, in such an embodiment, the organic polymer provides a sufficient amount of carbon to meet the requirement for at least 40 percent elemental carbon, although additional organic material may be present. In other embodiments, the organic material can be provided by organic polymer particles which, after printing, can be later fused.

Materials useful for making the ink-receiving layer or surface layer include, but are not limited to, open-cell voided polymeric films, microporous polymeric films filled with porous usually inorganic particles, nanofibers and/or microfibers, foamed films, sheets made up of organic particles, and/or combinations thereof, as long as providing 40% carbon elemental content at the surface. In addition, the surface layer can have properties that improve pigment affinity for the surface, pigment stability, general aesthetics (such as gloss or color), ink wetting, layer adhesion to a substrate, layer compatibility to a substrate and manufacturability. Pigment affinity for the surface can often be enhanced by adding cationic or anionic functionality (depending on the charge of ink pigments if used) to the layer to attract or mordant the pigments.

In particular, one embodiment involves an inkjet recording element in which the surface layer comprises microfibers and/or nanofibers, which are fine fibers that can be made into a non-woven fine-fiber layer. This can be applied, for example, as a coating onto an underlying layer or porous substrate. It is also possible to laminate. A variety of materials can be used, including a wide range of polymeric compositions including polyolefins such as Tyvek® polyolefin (DuPont, Wilmington, Del.).

The term "nanofiber" refers to elongated structures having a cross-section (angular fibers having edges) or diameter (rounded) less than 1 micron. The term "microfiber" refers to fibers with diameter larger than 1 micron, but not larger than 10 microns. This fine fiber can be made in the form of an improved single or multi-layer microfiber structure. Such fine-fiber layers can comprise a random distribution of fine fibers which can be bonded to form an interlocking net. Pigment trapping can be obtained largely as a result of the fine-fiber barrier to the passage of pigment particles. The fine-fiber interlocking networks have relatively small spaces between the fibers. Such spaces typically range, between fibers, from about 0.01 to about 25 microns or often about 0.1 to about 10 microns. Preferably, the fine fiber adds less than 3 microns in thickness to the overall inkjet media.

Polymer materials that can be used in the polymeric compositions of the nanofiber or microfiber include both addition polymer and condensation polymer materials such as polyolefin, polyacetal, polyamide, polyester, polyalkylene sulfide, polyarylene oxide, polysulfone, modified polysulfone polymers and mixtures thereof. Preferred materials that fall within these generic classes include polyethylene, polypropylene, poly(vinylchloride), polymethylmethacrylate (and other acrylic resins), polystyrene, and copolymers thereof (including ABA type block copolymers), poly(vinylidene fluoride), poly(vinylidene chloride), polyvinylalcohol in various degrees of hydrolysis in crosslinked and non-crosslinked forms.

In another embodiment, the surface layer or material for the ink-receiving layer can comprise a voided polymeric film which is voided by inorganic or organic particles. The voiding process is often accomplished by uniaxial or biaxial orientation. See, for example, U.S. Pat. No. 6,489,008 to Campbell, hereby incorporated by reference in its entirety and U.S. Ser. No. 10/722,866 to Laney et al., also hereby incorporated by reference. Preferably, in the case of an open-cell voided polymeric material, the material comprises a polyester or polyolefin or copolymers thereof. An example of an open-cell voided copolymer film is a voided polyester film such as described in U.S. Pat. No. 6,409,334. This porous polyester base unit layer can be coextruded with a non-voided polyester support layer if desired for additional support.

In still another embodiment, the surface layer can comprise a foamed film, for example, comprising a foamed polyethylene material. See, for example, U.S. Pat. Nos. 5,869,544; 5,677,355; and 6,353,037; relating to examples of various techniques for open-cell foaming, which patents are hereby incorporated by reference in their entirety.

In yet another embodiment, the surface layer comprises a microporous material made from polymeric films filled with porous, usually inorganic particles. For example, U.S. Pat. No. 5,605,750, hereby incorporated by reference, describes a microporous material that comprises siliceous filler particles distributed throughout a matrix of a thermoplastic organic polymer, for example, a polyolefin such as polyethylene or polypropylene. Similar materials are described in U.S. Pat. No. 6,025,068 to Pekala, in which the organic polymer comprises a poly(ethylene oxide) and a crosslinkable urethane-acrylic hybrid polymer; and in U.S. Pat. No. 5,326,391 to Anderson et al., in which the organic material comprises essentially linear ultrahigh molecular weight olefin such as polyethylene filled with silica particles, both patents hereby incorporated by reference in their entirety.

In another embodiment of the invention, the surface layer or material for the ink-receiving layer can comprise organic polymeric beads, for example, as described in U.S. Pat. No. 6,497,480 to Wexler, which beads are fusible after printing of the image. In this case the ink-receiving or upper layer receives the ink only temporarily and does not retain the ink, which is essentially transported to a lower ink-retaining layer, after which the beads are fused.

In addition to the primary material used in the surface layer, the surface layer can further comprise a mordant for providing pigment affinity for the surface of the layer as will be known to the skilled artisan. For example, a mordant can comprise a cationic or anionic functionality depending on the charge of the ink pigments. Examples of cationic mordant include metal atom containing groups and quaternary ammonium groups.

The porous image-receiving layer used in the invention preferably contains interconnecting voids. These voids provide a pathway for an ink to penetrate appreciably into the substrate, thus allowing the substrate, if porous with interconnecting voids, to contribute to the dry time. A non-porous image-receiving layer or a porous image-receiving layer that contains closed cells will not allow the substrate to contribute to the dry time.

Interconnecting voids in an image-receiving layer (also referred to as open cell) may be obtained by a variety of methods. For example, the layer may contain particles dispersed in a polymeric binder. The particles comprise organic or inorganic particles. Such particles can comprise a variety of materials, including but not limited to, for example, poly(methyl methacrylate), polystyrene, poly(butyl acrylate). The image-receiving layer can also comprise inorganic particles such as silica, alumina, zirconia, titania, calcium carbonate or barium sulfate. Such particles can have a particle size of from about 5 nm to about 15 μm.

Other additives may also be included in the image-receiving layer such as pH-modifiers like nitric acid, crosslinkers, rheology modifiers, surfactants, UV-absorbers, biocides, lubricants, dyes, dye-fixing agents or mordants, optical brighteners etc.

An image-receiving layer may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm.

The support for the inkjet recording element used in the invention can be any of those usually used for inkjet receivers, such as resin-coated paper, polyesters, laminated papers such as biaxially oriented support laminates, and polyolefin, e.g. polypropylene films. The supports may also be porous in nature with interconnecting voids such as paper, Tyvek® synthetic paper (DuPont Corp.), biaxially oriented and voided polyester films, and Teslin® SP synthetic printing sheet (PPG Industries Inc.).

The support used in the invention may have a thickness of from about 50 to about 500 microns, preferably from about 75 to about 300 microns. Antioxidants, antistatic agents, plasticizers and other known additives may be incorporated into the support, if desired.

After coating, the inkjet recording element may be subject to calendering or supercalendering to enhance surface smoothness.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

In a preferred embodiment of a printing process according to one aspect of the invention, at least one pigment is used to print an image on the inkjet recording element. The pigment used in the current invention can be either self-dispersible pigments such as those described in U.S. Pat. No. 5,630,868, encapsulated pigments as those described in the U.S. patent application Ser. No. 09/822,723 now abandoned; or can be stabilized by a dispersant. The process of preparing inks from pigments commonly involves two steps: (a) a dispersing or milling step to break up the pigment to the primary particle; and (b) a dilution step in which the dispersed pigment concentrate is diluted with a carrier and other addenda to a working strength ink. In the milling step, the pigment is usually suspended in a carrier (typically the same carrier as that in the finished ink) along with rigid, inert milling media. Mechanical energy is supplied to this pigment dispersion, and the collisions between the milling media and the pigment cause the pigment to deaggregate into its primary particles. A dispersant or stabilizer, or both, is commonly added to the pigment dispersion to facilitate the deaggregation of the raw pigment, to maintain colloidal particle stability, and to retard particle reagglomeration and settling.

Pigments which may be used in the invention include organic and inorganic pigments, alone or in combination, such as those as disclosed, for example in U.S. Pat. Nos. 5,026,427; 5,086,698; 5,141,556; 5,160,370; and 5,169,436. The exact choice of pigments will depend upon the specific application and performance requirements such as color reproduction and image stability. Pigments suitable for use in the present invention include, for example, azo pigments, monoazo pigments, disazo pigments, azo pigment lakes, β-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black. Typical examples of pigments which may be used include Color Index (C.I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C.I. Pigment Orange 1, 2, 5, 6, 13, 15, 16, 17, 17:1, 19, 22, 24, 31, 34, 36, 38, 40, 43, 44, 46, 48, 49, 51, 59, 60, 61, 62, 64, 65, 66, 67, 68, 69; C.I. Pigment Red 1, 2, 3, 4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Violet 1, 2, 3, 5:1, 13, 19, 23, 25, 27, 29, 31, 32, 37, 39, 42, 44, 50; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66; C.I. Pigment Green 1, 2, 4, 7, 8, 10, 36, 45; C.I. Pigment Black 1, 7, 20, 31, 32, and C.I. Pigment Brown 1, 5, 22, 23, 25, 38, 41, 42. In a preferred embodiment of the invention, the pigment employed is C.I. Pigment Blue 15:3, C.I. Pigment Red 122, C.I. Pigment Yellow 155, C.I. Pigment Yellow 74, bis (phthalocyanylalumino)tetraphenyldisiloxane or C.I. Pigment Black 7.

Regarding an aqueous carrier medium for the ink compositions, a suitable mixture of water and at least one water miscible co-solvent can be selected depending on the requirements of the specific application, such as desired surface tension and viscosity, the selected pigment, drying time of the pigmented inkjet ink, and the type of paper onto which the ink will be printed. Representative examples of water-miscible co-solvents that may be selected include (1) alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; (2) ketones or ketoalcohols such as acetone, methyl ethyl ketone and diacetone alcohol; (3) ethers, such as tetrahydrofuran and dioxane; (4) esters, such as ethyl acetate, ethyl lactate, ethylene carbonate and propylene carbonate; (5) polyhydric alcohols, such as ethylene glycol, diethylene glycol, triethylene glycol, tetraethylene glycol, propylene glycol, polyethylene glycol, glycerol, 2-methyl-2,4-pentanediol 1,2,6-hexanetriol and thioglycol; (6) lower alkyl mono- or di-ethers derived from alkylene glycols, such as ethylene glycol mono-methyl (or -ethyl) ether, diethylene glycol mono-methyl (or -ethyl) ether, diethylene glycol mono-butyl (or -ethyl) ether, propylene glycol mono-methyl (or -ethyl) ether, poly(ethylene glycol) butyl ether, triethylene glycol mono-methyl (or -ethyl) ether and diethylene glycol di-methyl (or -ethyl) ether; (7) nitrogen containing cyclic compounds, such as pyrrolidone, N-methyl-2-pyrrolidone, and 1,3-dimethyl-2-imidazolidinone; and (8) sulfur-containing compounds such as dimethyl sulfoxide, 2,2'-thiodiethanol, and tetramethylene sulfone.

In general, it is desirable to make a pigmented inkjet ink in the form of a concentrated mill grind, which is subsequently diluted to the appropriate concentration for use in the inkjet printing system. This technique permits preparation of a greater quantity of pigmented ink from the equipment. If the mill grind was made in a solvent, it is diluted with water and optionally other solvents to the appropriate concentration. If it was made in water, it is diluted with either additional water or water miscible solvents to the desired concentration. By dilution, the ink is adjusted to the desired viscosity, color, hue, saturation density, and print area coverage for the particular application. The method for the preparation of the mill grind is disclosed in U.S. Pat. Nos. 5,679,138; 5,670,139; and 6,152,999. In a preferred embodiment of the invention, a dispersant is also added to the inkjet ink composition and is used to break down the pigment to sub-micron size during the milling process and keeps the colloidal dispersion stable and free from flocculation for a long period of time.

In the case of organic pigments, the ink may contain up to approximately 30% pigment by weight, but will generally be in the range of approximately 0.1 to 10%, preferably approximately 0.1 to 5%, by weight of the total ink composition for most inkjet printing applications. If an inorganic pigment is selected, the ink will tend to contain higher weight percentages of pigment than with comparable inks employing organic pigments, and may be as high as approximately 75% in some cases, since inorganic pigments generally have higher specific gravities than organic pigments.

The amount of aqueous carrier medium employed is in the range of approximately 70 to 99 weight %, preferably approximately 90 to 98 weight %, based on the total weight of the ink. A mixture of water and a polyhydric alcohol, such as diethylene glycol, is useful as the aqueous carrier medium. In a preferred embodiment, the inks contain from 5 to 60 weight % of water miscible organic solvent. Percentages are based on the total weight of the aqueous carrier medium.

A humectant can be added to the ink composition to help prevent the ink from drying out or crusting in the orifices of the inkjet printhead. Polyhydric alcohol humectants useful in the composition employed in the invention for this purpose include, for example, ethylene glycol, diethylene glycol, triethylene glycol, propylene glycol, tetraethylene glycol, polyethylene glycol, glycerol, 2-methyl-2,4-pentanediol, 1,2,6-hexanetriol, and thioglycol. The humectant may be employed in a concentration of from 10 to 50% by weight. In a preferred embodiment, diethylene glycol or a mixture of glycerol and diethylene glycol is employed at a concentration of between 10 and 20% by weight.

The ink preferably has physical properties compatible with a wide range of ejecting conditions, i.e., driving voltages and pulse widths for thermal inkjet printing devices, driving frequencies of the piezo element for either a drop-on-demand device or a continuous device, and the shape and size of the nozzle.

A penetrant (0–10% by weight) may also be added to the ink composition employed in the process of the invention to help the ink penetrate the receiving substrate, especially when the substrate is a highly sized paper. A preferred penetrant for the inks employed in the present invention is n-propanol at a final concentration of 1–6% by weight.

A biocide (0.01–1.0% by weight) may also be added to the ink composition employed in the process of the invention to prevent unwanted microbial growth which may occur in the ink over time. A preferred biocide for the inks employed in the present invention is Proxel® GXL (Zeneca Colours Co.) at a concentration of 0.05–0.5% by weight. Additional additives which optionally may be present in inkjet inks include thickeners, conductivity enhancing agents, anti-kogation agents, drying agents, and defoamers.

A polymeric binder may also be added to the pigmented ink. The polymeric binder can be either water soluble or water dispersible. The polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, and copolymers formed from various combinations of these monomers.

Another aspect of the present invention relates to an inkjet printing method that comprises the steps of: (1) providing an inkjet printer that is responsive to digital data signals; (2) loading said printer with an inkjet recording element as described above, (3) loading said printer with an inkjet ink composition, preferably a pigment-based ink composition comprising, for example, water, a humectant, and a pigment or dye; and (4) printing on the inkjet recording element using the inkjet ink in response to the digital data signals.

As indicated above, commercially available inkjet printers use several different methods to control the deposition of the ink droplets. Such methods are generally of two types: continuous stream and drop-on-demand.

In drop-on-demand systems, a droplet of ink is ejected from an orifice directly to a position on the ink receiving layer by pressure created by, for example, a piezoelectric device, an acoustic device, or a thermal process controlled in accordance with digital data signals. An ink droplet is not generated and ejected through the orifices of the print head unless it is needed. Inkjet printing methods, and related printers, are commercially available and need not be described in detail.

Plasma treatment (also referred to as electrical discharge treatment) is widely used to promote adhesion of a variety of organic and inorganic layers to organic polymer substrates. Examples of the use of electrical discharge treatments are found in U.S. Pat. No. 5,538,841 and references cited therein, hereby incorporated by reference. A variety of treatment geometries (i.e. positioning of the article to be treated relative to the discharge electrodes, shape of the electrodes, and shape of the article to be treated) are possible (see, for example U.S. Pat. Nos. 3,288,638 and 3,309,299). The electrical discharge or plasma treatment can be performed in the presence of a variety of gases including air (comprising oxygen and nitrogen), oxygen, nitrogen, etc. to impart the desired surface chemistries for improved dot spread. Plasma treatment includes corona discharge treatment (CDT), sometimes also referred to as glow discharge treatment, a common technique in the industry for treatment of surfaces at atmospheric pressures. See, for example, R. H. Cramm and D. V. Bibee, Tappi, 65 (8), pp. 75–8 (1982); and W. J. Ambusk, U.S. Pat. No. 3,549,406. Techniques and apparatus for treating continuous sheets or rolls of material (i.e., webs), in which a web is conveyed through an electrical discharge zone, are described in U.S. Pat. Nos. 6,399,159 and 6,149,985 to Grace et al., both patents hereby incorporated by reference. For web treatment on the manufacturing scale, a suitable dose parameter for produce improved dot spread can be calculated based on the delivered power, the width of the treatment zone and the web speed: Dose=Power/[width×web speed]. In one embodiment, using CDT in air, doses in the range of about 0.5 to 20 J/cm$^2$, preferably about 2 to 10 J/cm2 are used to provide improved dot spread.

The following examples further illustrate the invention.

EXAMPLES

Example Receiver 1

7 mil Teslin® SP (porous) Synthetic Printing Sheet (PPG Industries Inc.) Teslin® sheet is a polyolefin-based highly filled microporous film, typically comprising about 60% by weight of inorganic filler and about 65% by volume air.

Example Receiver 2

An ink-permeable polyester film made as follows: A three-layered polyester substrate comprising an impermeable core polyester layer and an ink-permeable upper and lower polyester layer was prepared using 1) a poly(ethylene terephthalate)(PET) resin (IV=0.70 dl/g) for the core layer; 2) a compounded blend for the top and bottom layers consisting of 29% by weight of an amorphous polyester resin, PETG® 6763 resin (IV=0.73 d/g)(Eastman Chemical Company), 29% by weight poly(ethylene terephthalate) (PET) resin (IV=0.70 dl/g), and 42% by weight of cross-linked poly(methylmethacrylate)(PMMA) particles approximately 1.7 μm in size.

The cross-linked PMMA particles were compounded with the PETG® 6763 and the PET polyester resins through mixing in a counter-rotating twin-screw extruder attached to a pelletizing die. The extrudate was passed through a water bath and pelletized.

The two resins for the three layers were dried at 65° C. and fed by two plasticating screw extruders into a coextrusion die manifold to produce a three-layered melt stream which was rapidly quenched on a chill roll after issuing from the die. By regulating the throughputs of the extruders, it was possible to adjust the thickness ratio of the layers in the cast laminate sheet. In this case, the thickness ratio of the three layers was adjusted at 1:6:1 with the thickness of the two outside layers being approximately 250 um. The cast sheet was first oriented in the machine direction by stretching at a ratio of 3.3 and a temperature of 110° C.

The oriented substrate was then stretched in the transverse direction in a tenter frame at a ratio of 3.3 and a temperature of 100 ° C. In these examples, no heat setting treatment was applied. The final total film thickness was 200 μm with the permeable top and bottom layers being 50 μm each, and the layers within the substrate were fully integrated and strongly bonded. The stretching of the heterogeneous top and bottom layers created interconnected microvoids around the hard cross-linked PMMA beads, thus rendering this layer opaque (white) and highly porous and permeable. The PET core layer, however, was impermeable and retained its natural clarity.

Control Receiver 1

A porous, glossy receiver consisting of two layers on a polyethylene-coated paper. The bottom layer consisted of fumed alumina, Cab-O-Sperse® PG003, (Cabot Corp.), polyvinyl alcohol, GH-23®, (Nippon Ghosei) and 2,3-dihydroxy-1,4-dioxane (Clarient Corp.) at a weight ratio of 87:9:4 and a thickness of 38 um. The top layer consisted of fumed alumina, Cab-O-Sperse® PG003, (Cabot Corp.), polyvinyl alcohol, GH-23®, (Nippon Ghosei), surfactant Zonyl® FSN (DuPont Corp) and dye mordanting material M-1 at a weight ratio of 69:6:5:20 and a thickness of 2 μm. M-1 was a crosslinked hydrogel polymer particle of 80 nm in average particle size prepared from 87% by weight of N-vinylbenzyl-N,N,N-trimethylammonium chloride and 13% by weight of divinylbenzene.

Control Receiver 2

Epson® Premium Glossy Photo Paper S041286 (Seiko Epson Corporation), which is similar to Control Receiver 1 with a high level of inorganic particles, in this case silica instead of alumina.

Control Receiver 3

0.1 μm MF Millipore® membrane filter (Millipore Corporation), which is a microporous polymeric membrane material made from mixed cellulose esters.

Control Receiver 4

Kodak® Premium Picture Paper for Ink Jet Prints (Eastman Kodak Company). This receiving element consists of a support having thereon a continuous, coextensive, non-porous, swellable, ink-receiving layer comprising a hydrophilic polymer which is capable of absorbing and retaining ink.

Surface Analysis of Receiver Samples

All receiver samples were analyzed on the imaging side surface (at a depth of 5 nm) for elemental content using X-ray photoelectron spectroscopy (XPS). The XPS unit was made by Physical Electronics, Model PHI 5600® ESCA System. Shown in Table 1 are the surface elemental compositions of the receiver samples.

TABLE 1

| | % Oxygen | % Carbon | % Silicon | % Aluminum | % Nitrogen | % Fluorine | % Chlorine |
|---|---|---|---|---|---|---|---|
| Example Receiver 1 | 18.01 | 73.99 | 8.00 | ND | ND | ND | ND |
| Example Receiver 2 | 25.37 | 74.63 | ND | ND | ND | ND | ND |
| Control Receiver 1 | 38.62 | 39.78 | ND | 17.62 | 1.18 | 1.47 | 1.33 |
| Control Receiver 2 | 54.43 | 24.85 | 20.37 | ND | 0.35 | ND | ND |
| Control Receiver 3 | 50.39 | 39.00 | ND | ND | 10.61 | ND | ND |
| Control Receiver 4 | 31.91 | 59.71 | ND | ND | 0.39 | 7.66 | 0.33 |

ND = none detected

Plasma Treatment

All samples were treated on the imaging side in an air environment with the corona discharge treating (CDT) unit made by Enercon Industries Corporation, Model LM2483-02®. The CDT was applied at 68.59 KJ/m$^2$ (6372 Joules/ft$^2$). The plasma treatment may affect the elemental content as determined by XPS.

Printing

Images were printed on both corona treated and non-corona treated samples using a Mutoh 3038® wide format printer and Epson 9500® pigment based inks with cartridges Black T474, Yellow T475, Magenta T476 and Cyan T477. The images contained 25%, 50%, 75% and 100% ink coverage blocks of cyan, magenta, yellow, red, green, blue, and black colors. These blocks were approximately 1 cm by 1 cm in size. In addition, the images contained 100% ink coverage blocks of cyan, magenta, yellow, red, green, blue, and black adjacent to each other for drytime measurements. These blocks were approximately 1 cm by 1.5 cm in size.

Drytime

Immediately after ejection from the printer, the printed image was set on a flat surface. The seven adjacent color blocks were then wiped with the index finger under normal pressure in one pass. The index finger was covered with a rubber finger cot. The drytime was rated as 5 when all of the color blocks smeared after wiping. The drytime was rated as 1 when no smearing was observed. Intermediate drytimes were rated between 1 and 5.

Coalescence

Coalescence is an unwanted imaging artifact in which ink puddles at the surface and leads to non-uniform densities. This is usually most obvious in the printed areas containing secondary colors such as red, green, blue, and black. The coalescence was rated visually by inspecting the red, green, and blue color blocks. A rating of 1 indicated no observed coalescence. A rating of 5 indicated severe coalescence. Intermediate coalescence artifacts were rated between 1 and 5.

Image Density

The densities of the 50% ink coverage magenta blocks in the printed images were measured using an X-Rite® Densitometer Model 820. A % density change of less than 5% is considered non-detectable by the human eye and within the testing variability.

Average Ink Dot Area

To show the effect of plasma treatment on ink dot spread, the areas (measured in the 25% ink coverage blocks) of cyan dots on both the non-treated and plasma treated receivers were measured using a Zeiss Axioplan 2® microscope at a 10× magnification. The calculation was based on the average of three dots. The changes in dot sizes and image density are shown in Table 2.

TABLE 2

| | CDT Level (KJoules/m$^2$) | Avg. Cyan Dot Area (μm$^2$) | % Change | 50% Cyan Density | % Change | Coalescence | Drytime |
|---|---|---|---|---|---|---|---|
| Example Receiver 1 | 0 | 2780 | | 0.25 | | 1 | 1 |
| Example Receiver 1 | 68.59 (6372 J/ft$^2$) | 4055 | +46 | 0.32 | +28 | 1 | 1 |
| Example Receiver 2 | 0 | 8216 | | 0.49 | | 1 | 1 |
| Example Receiver 2 | 68.59 (6372 J/ft$^2$) | 9771 | +19 | 0.53 | +8 | 1 | 1 |
| Control Receiver 1 | 0 | 3206 | | 0.40 | | 3 | 1 |
| Control Receiver 1 | 68.59 (6372 J/ft$^2$) | 3459 | +8 | 0.39 | −2 | 3 | 1 |
| Control Receiver 2 | 0 | 2879 | | 0.36 | | 1 | 1 |
| Control Receiver 2 | 68.59 (6372 J/ft$^2$) | 2929 | +2 | 0.35 | −3 | 1 | 1 |
| Control Receiver 3 | 0 | 2644 | | 0.26 | | 1 | 1.5 |
| Control Receiver 3 | 68.59 (6372 J/ft$^2$) | 2928 | +11 | 0.25 | −4 | 1 | 1.5 |
| Control Receiver 4 | 0 | 2914 | | 0.39 | | 5 | 3 |
| Control Receiver 4 | 68.59 (6372 J/ft$^2$) | 4075 | +40 | 0.47 | +21 | 5 | 3 |

The above results show that plasma-treated receiving elements employed in the invention gave improved dot spread, printed densities, coalescence, and drytimes when compared to the control elements. While plasma treated control receivers 1, 2 and 3 showed good drytime results, they did not show any significant increase in printed densities. Non-porous, plasma treated control receiver 4 showed significant improvement in printed density but had unacceptable coalescence and drytime results.

This invention has been described with particular reference to preferred embodiments thereof but it will be understood that modifications can be made within the spirit and scope of the invention.

What is claimed is:

1. An inkjet recording element comprising, as a top layer, a porous image-receiving layer comprising an upper surface for receiving an image, the upper surface having been modified by plasma treatment, wherein the porous image-receiving layer before plasma treatment contains at least about 40% elemental carbon at the surface, wherein the porous image-receiving layer is an open-cell voided polymeric film, in which the composition of polymer in the continuous phase consists of polyester comprising poly (ethylene terephthalate) voided by organic or inorganic particles and containing no detectable silicon.

2. The inkjet recording element of claim 1 wherein the extruded open-cell voided polymeric film consists of a compounded blend of poly(ethylene terephthalate) and amorphous polyester resin, which film is voided by organic or inorganic particles.

3. The inkjet recording element of claim 1 wherein the porous image-receiving layer further comprises a mordant for providing pigment affinity for the porous image-receiving layer.

4. The recording element of claim 1 wherein the porous polymeric image-receiving layer is above a support.

5. The inkjet recording element of claim 4 wherein the support is a material selected from the group consisting of cellulosic paper, resin-coated paper, polyester, polyolefin, synthetic paper, and combinations thereof.

6. The inkjet recording system of claim 5 wherein the support comprises paper that is resin coated with a polyethylene layer on its back.

7. The inkjet recording system of claim 5, further comprising an antistat or anticurl layer below the support.

8. The recording element of claim 4 further comprising at least one intermediate ink-permeable base layer between the support and the image-receiving layer.

9. The recording element of claim 8 wherein the base layer comprises a voiding agent to an extent less than about 30% to about 50% by volume of the base layer.

10. The recording element of claim 8 wherein the base layer comprises a polyester.

11. The recording element of claim 8 wherein the support comprises paper laminated to a side of the base layer which does not have thereon the image-receiving layer.

12. The inkjet recording element of claim 1 wherein the plasma treatment comprises corona discharge treatment in the presence of air, nitrogen, or oxygen.

13. The inkjet recording element of claim 1 wherein the polymeric film is filled with inorganic porous particles.

14. The inkjet recording element of claim 1 wherein the open-cell voided polymeric film is coextruded with a non-voided polymeric backing film.

* * * * *